US007490375B2

(12) United States Patent
Luk

(10) Patent No.: US 7,490,375 B2
(45) Date of Patent: Feb. 17, 2009

(54) FOOD PREPARATION SINK TRASH INTERCEPTOR SYSTEM

(76) Inventor: Ricky Wangchi Luk, 2941 W. MacArthur Blvd. Unit 138, Irvine, CA (US) 92704

( * ) Notice: Subject to any disclaimer, the term of this patent is extended or adjusted under 35 U.S.C. 154(b) by 0 days.

(21) Appl. No.: 11/895,201

(22) Filed: Aug. 23, 2007

(65) Prior Publication Data

US 2007/0289058 A1 Dec. 20, 2007

Related U.S. Application Data

(63) Continuation-in-part of application No. 11/494,422, filed on Jul. 27, 2006, which is a continuation-in-part of application No. 11/285,520, filed on Nov. 22, 2005.

(51) Int. Cl.
*E03C 1/00* (2006.01)

(52) U.S. Cl. ..... 4/629; 4/289; 210/238

(58) Field of Classification Search ..... 4/288–291, 4/629; 210/237–238, 322, 447
See application file for complete search history.

(56) References Cited

U.S. PATENT DOCUMENTS 2,353,993 A * 7/1944 Cavicchioli ..... 4/629
2,498,502 A * 2/1950 O'Brien ..... 4/629
3,874,006 A * 4/1975 Ritter ..... 4/629
4,472,277 A * 9/1984 Bailey et al. ..... 210/238
4,847,927 A * 7/1989 Blanc ..... 4/629

* cited by examiner

*Primary Examiner*—Charles E Phillips
(74) *Attorney, Agent, or Firm*—Clement Cheng

(57) ABSTRACT

A garbage disposer replacement unit for straining food waste comprises a drainage means fitted to one or more sink for transporting food wastes to a sewer system and a main interceptor connected in series with the drainage means. The main interceptor is fluidly connected in series to the sink drain outlet through an adapter funnel and includes a convex reservoir and a number of legs for supporting the main interceptor above a floor. Two opposite side outlets are positioned at the lowermost level of the convex reservoir. A tray is slidingly suspended within the main interceptor above the reservoir, wherein the tray has fine bottom perforations for retaining small particles of food waste. A draining basket is removably positioned under the side outlets for catching escaped wastes bypassing the main interceptor. The interceptor has a top opening over which the adaptor funnel is placed concentrically to redefine the top opening to fit with the existing sink drainage means.

9 Claims, 12 Drawing Sheets

FOOD PREPARATION SINK TRASH INTERCEPTOR SYSTEM

CROSS REFERENCE TO RELATED APPLICATIONS

This application is a continuation-in-part application of co-pending U.S. patent application Ser. No. 11/494,422 filed Jul. 27, 2006, which is a continuation-in-part application of U.S. patent application Ser. No. 11/285,520 filed Nov. 22, 2005.

BACKGROUND OF THE INVENTION

A. Field of the Invention

The present invention relates to a garbage disposal, and more particularly to a garbage disposer unit for use in food industries to replace motorized disposers that have become an environmentally harmful way to dispose of food wastes.

B. Description of Related Art

Restaurant food waste from rinsed dirty dishes is an environmental problem. Although garbage disposers are highly efficient at disposing of food waste at a high rate, unfortunately they have various problems. Drain waste has the potential to create public health hazards. Excessive food service waste can overburden community wastewater systems and consequently, the oceans and streams of our natural environment. In this regard, the currently popular powered garbage disposers are problematic. Heavy-duty disposers have a high initial cost and maintenance with lost operation time at busy restaurants when they need fast dish washing with food disposal. Some cities such as Irvine, Calif. have banned garbage disposers because of the environmental awareness that the motorized disposers basically excrete food waste in a slurry state to the rivers and public facilities where it is difficult to be recycled into potable water.

Thus, the food waste will eventually end up in the ocean where it can cause bacteria blooms and other environmental disasters.

One alternative to the garbage disposer is a strainer system to catch food waste from rinsed dirty dishes. Strainers built into the piping system have been used for more than a hundred years. U.S. Pat. No. 495,998 shows a sink trap design patented in 1893, the disclosure of which is incorporated herein by reference. A larger unit is shown in U.S. Pat. No. 960,901 to Hall for a trap for kitchen sinks patented in 1910, the disclosure of which is incorporated herein by reference. Hall shows a top strainer removable for cleaning and a bottom strainer. A horizontal line strainer was invented by Buker as shown in U.S. Pat. No. 2,915,188 patented in 1957, the disclosure which is incorporated herein by reference. The Buker device allows a continuous horizontal flow having a removable screen. A more recent improvement is seen in U.S. Pat. No. 4,045,351 to Peterson patented Aug. 30, 1977, the disclosure of which is incorporated herein by reference. The Petersen device has a removable strainer mounted below a sink. While the previously cited patented inventions may help with household drain straining, they are not well suited to a high flow restaurant type of environment. They also have inconvenient design features that would not allow their use as a replacement of a garbage disposer.

U.S. application Ser. No. 11/285,520 filed by the present inventor and incorporated in its entirety herein by reference discloses a garbage disposer replacement unit that is fixed under a kitchen sink where an electric disposer has left. The garbage disposer replacement unit includes a pre-rinse basket with food waste straining holes. The unit comprises a main body housing a tray slidingly suspended that retains small particles food waste via fine bottom perforations. The tray has a top opening larger than a drain diameter of an existing bus bowl in a kitchen. A plastic clip disc pairs with top clip members to clip the main body onto bus bowl flanges. A clip disc drain adapter adjusts and adapts the unit's outlet to different drain diameters of existing bus bowl fixtures. The clip disc and top clip members constitute a clip assembly for adjustably clipping the unit main body to the given drain flange. Optionally, a four-legged riser replaces the clip assembly to attach to the unit main body top for bus bowls with a flangeless standard drain fitting.

U.S. patent application Ser. No. 11/494,422 of the present inventor suggested an alternative garbage disposer replacement unit comprising a drainage means fitted to one or more sink for transporting food wastes to a sewer system, a self-standing main body connected in series with the drainage means, the main body having a reservoir and a number of legs for supporting the main body above a floor. The trash interceptor has a large top opening and a centrally opened adaptor plate to redefine the top opening to fit with the drainage means for the existing sinks in the kitchen.

This trash interceptor still has a room for improvement to adapt to more varied kitchen space for a heightened workflow and less maintenance by the users.

Therefore, the object of the present invention is to provide a garage disposer replacement unit that can be installed immediately in place of a motorized disposer unit using a simple installation means.

Another object of the present invention is to provide a kitchen sink trash interceptor structure that is easily adaptable to different fixture devices to promote a swift transition to manage food waste more environmentally friendly.

Yet another object of the present invention is to provide a clip-on device for installation of a detachable under-sink trash interceptor, which clip-on device is easily adaptable to various existing drain sizes of the sink fixture.

Yet another object of the present invention is to provide a screw-on trash interceptor for a swift installation of a detachable under-sink unit to the sink fixture, which has standard existing drain fittings.

Yet another object of the present invention is to provide an improved floor trash interceptor that does not require a special fixture to the sink.

Yet another object of the present invention is to provide a means for simply adapting the trash interceptor to fit different diameters of the drainage system of individual kitchens.

SUMMARY OF THE INVENTION

A garbage disposer replacement unit according to a first embodiment of the present invention includes a pre-rinse basket which can be custom made of stainless steel. The basket has multiple straining holes for filtering larger food chunks off dishes by dishwashing personnel.

Below the basket is a unit that primarily comprises a main body constructed by sheets of stainless steel bent and welded or stamped into a shape of a drawer box with a deep bottom floor for holding an accumulation of food wastes for controlled disposal. The main body has a front rectangular opening through which a tray enters and slidably suspended in the interior of the main body. The tray has fine perforations at its bottom to filter out small particles of food wastes that pass the large holes of the basket. The tray has a top opening that is much larger than an available drain diameter of an existing bus bowl in a kitchen. This allows it to receive the first filtered wastes down the bus bowl.

According to a first embodiment of installation of the main unit body to the sink fixture of a bus bowl, a clip disc formed of a plastic is paired with a number of clip top members to clip the main body onto the flanges of the bus bowl with the assistance of a fastening means. The clip disc has a drain adapter to adapt the unit's hole to the different drain diameters of existing bus bowl fixtures. An optional hole diameter is defined by the innermost of multiple annular grooves, which may be sawn off by an installer of the unit. The clip disc and a top clip member constitute a clip assembly for adjustably clipping the unit main body to the given drain flange easily but securely.

An alternative embodiment is offered to the clip assembly made by the clip disc and a top clip member in installing the unit main body to the kind of bus bowl that does not have an integral drain flange commonly found on garbage disposers but a standard drain fitting screwed in an opening formed in the bus bowl. A riser is provided with an annular plate to conform to the bottom of the drain fitting and four legs protruding diametrically outwardly and downwardly of the annular plate. Each of the legs has a horizontal foot section formed with a bolt hole. A ring screw that is already in the drain fitting may be used to fasten the annular plate leaving the four legs free for attachment by the unit main body.

The unit main body is attached by a fastening means including the bolts threaded from the interior of the main body through metal rings and the bolt holes of the foot sections, which abut the top plain of the main body. Then, the rings and nuts at the four feet around the annular plate securely fasten protruding ends of the bolts.

A garbage disposer replacement unit according to a second embodiment of the present invention provides a means for straining food waste more environmentally friendly and comprises a drainage means fitted to one or more sink for transporting food wastes to a sewer system, a main body connected in series with the drainage means, the main body having a reservoir and a number of legs for supporting the main body above a floor, a tray slidingly suspended within the main body above the reservoir, wherein the tray has fine bottom perforations, and a draining basket removably positioned under the drainage means for catching escaped wastes bypassing the main body.

The tray of the main body retains small particles food waste via fine bottom perforations.

The tray has a large top opening and a centrally opened adaptor plate to redefine the top opening to fit with the drainage means for the existing sinks in the kitchen.

The main body of the garbage disposer replacement unit also has a large opening on its top surface and a set of adaptor plates each having a predetermined diameter of central opening and a number of peripheral bolt holes for attaching a selected adaptor plate to the main body for redefining the large opening of the main body to fit with the drainage means.

The supporting legs of the main body each has threaded sections movable relative to each other along a common longitudinal axis to adjust the length of the leg, whereby the main body stands at level.

A garbage disposer replacement unit according to a third embodiment of the present invention comprises a main body connected in series with the drainage means, the main body having a reservoir contoured to flow water efficiently and a number of legs for supporting the main body above a floor, a tray slidingly suspended within the main body above the reservoir, wherein the tray has fine bottom perforations, and a draining basket removably positioned under the drainage means for catching escaped wastes bypassing the main body.

Embodiments of the invention will now be described by way of example with reference to the accompanying drawings.

DETAILED DESCRIPTION OF THE PREFERRED EMBODIMENT

Figure 1:
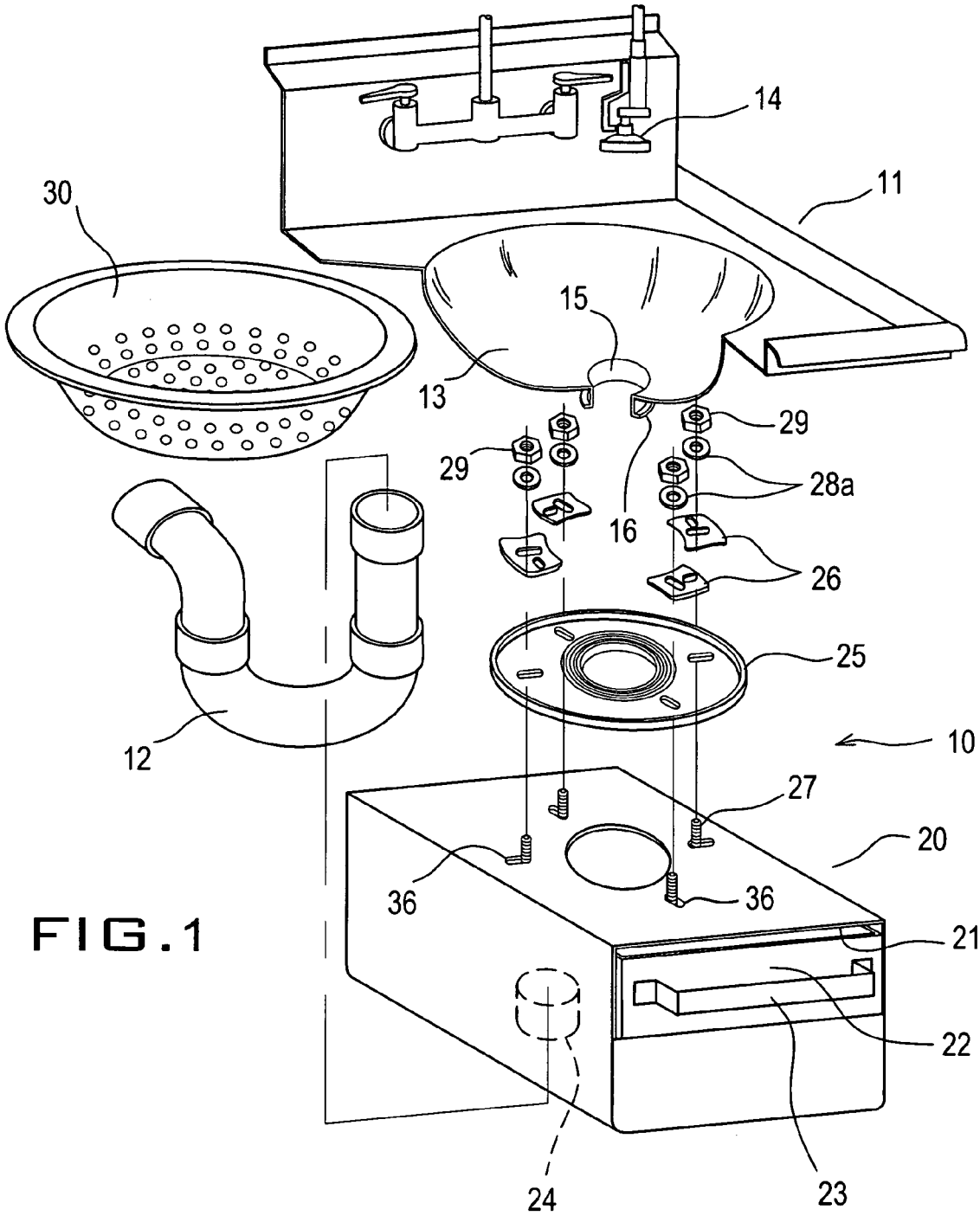
FIG. 1 is a perspective view of the garbage disposer replacement unit according to a first embodiment of the present invention as applied to a kitchen sink shown partially broken away.

Referring to FIG. 1, a garbage disposer replacement unit according to the present invention is generally referenced by number 10 and is shown in an exploded view to show its installation to a kitchen sink 11 as well as a wall plumbing 12 typical in any kitchen setting. The kitchen sink 11 has a bus bowl 13 wherein dishes are washed as it drains wastes with running water from a faucet 14. At the bottom enter of the bus bowl 13 is formed a typical drain 15 with certain diameter terminated by outward flanges 16 for installing a waste treatment means such as a motorized garbage disposer, which the inventive sink unit 10 is replacing.

Different bus bowls with various drain diameters have produced and are available in the market. For, example, small drains are sized 3½", 4", 4½", 5", 5½", 6", and 6½". Bigger drains include diameters of 7½", 8", 8½" and 9".

The garbage disposer replacement unit is also called a sink unit 10. The sink unit 10 comprises a main body 20 constructed by sheets of stainless steel bent and welded into a shape of a drawer box with a deep bottom floor for holding an accumulation of food wastes for controlled disposal. The main body 20 has a front rectangular opening 21 though which a tray 22 enters and slidably suspended in the interior of the main body 20. An oversized handle 23 is attached to the tray 22 for handling the same in its sliding in and out as well as transporting the filtered wastes. A secondary drain 24 formed in the bottom of the main body 20 is adapted to connect with the wall plumbing 12.

A clip disc 25 formed of a plastic is paired with an exemplary number of four clip top members 26 to clip the main body 20 onto the flanges 16 of the bus bowl 13 with the assistance of a fastening means including four upward threading bolts 27 from the interior of the man body 20, metal rings 28*a* and nuts 29, which is further detailed below.

The sink unit 10 includes a pre-rinse basket 30 which can be custom made of stainless steel. The basket 30 has multiple straining holes for roughly filtering food wastes off dishes by dishwashing personnel who will use the sink unit 10. The straining basket has straining holes preferably circular 4-7 mm diameter. The basket straining holes can be adjusted by about 60% without substantial performance degradation, but the best mode is 5-6 mm.

Figure 2:
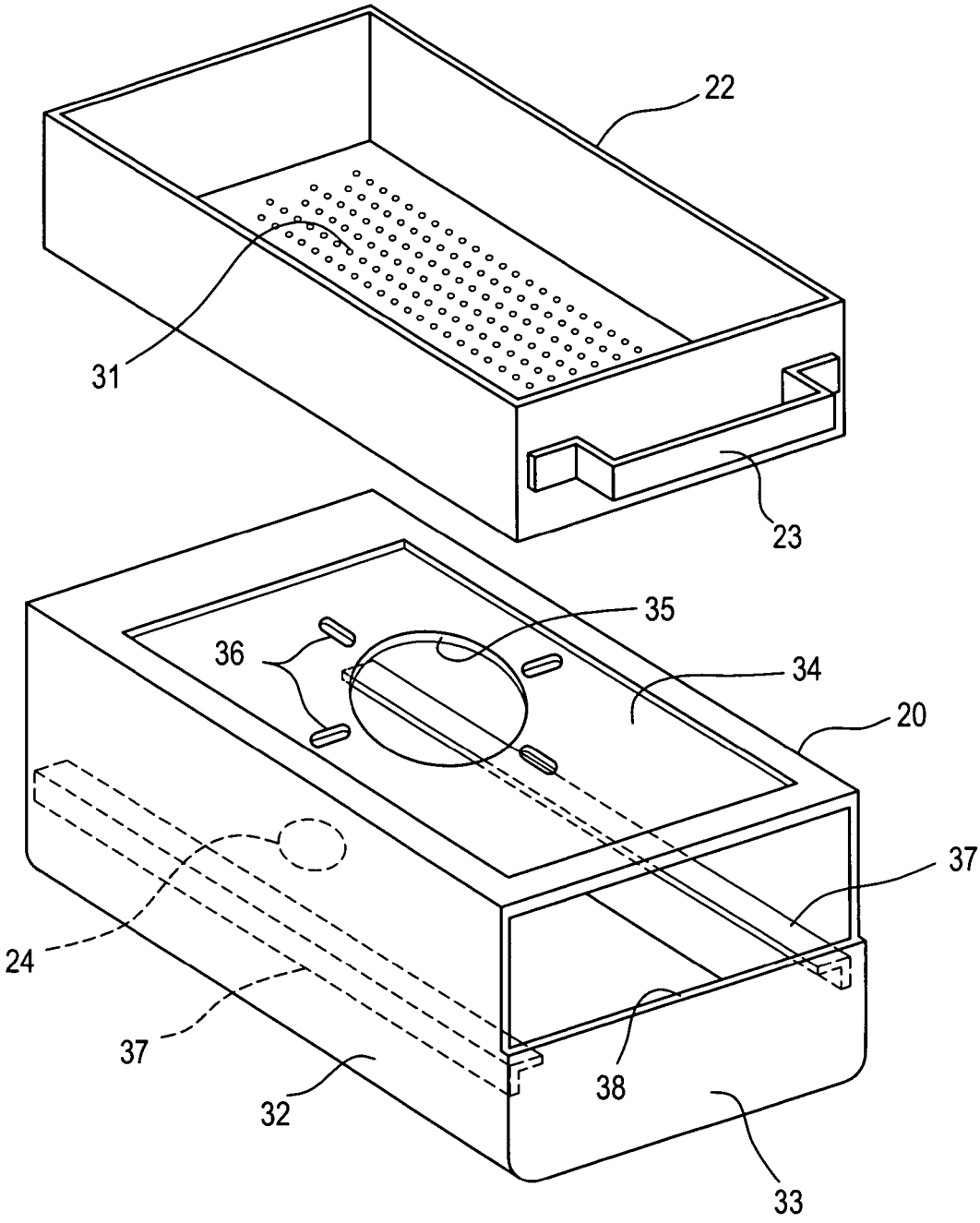
FIG. 2 is a perspective view of the main body of the garbage disposer replacement unit of FIG. 1.

FIG. 2 shows the main body 20 of the sink unit 10 in more detail where the tray 22 is taken out for a better view. The tray 22 is in the shape of a drawer with four sidewalls and a bottom wall formed with perforations 31 to filter out wastes at a finer level than that of the straining holes of the basket 30. The tray perforations are preferably 1-3 mm diameter circular apertures. The diameter can be adjusted by about up to 40% without substantial performance degradation, but the best mode is 2 mm.

The main body 20 is provided by a number of sheet members which may comprise a side plate 32 bent generally in U-shape, a front plate 33 for closing substantially the bottom half of an end opening of the side plate 32, a rear plate for closing the entire opposite end opening of the side plate 32 not shown and a top plate 34 to cover the top opening of the side plate 32. The main body 20 may be fabricated by known methods of fastening metal such as stamping, spot welding, laser welding to name a few.

The top plate 34 has an annular opening 35 that is bigger than an available drain diameter as listed above and is positioned to communicate with the drain 15 of the bus bowl 13.

Also formed in the top plate 34 are four elongated openings 36 to position the threads of the bolts 27 at adjustable locations toward and away from the center of the annular opening 35 for the purpose described below.

A pair of horizontal guide rails 37 having an L-shaped cross section are welded inside of the side plate 32 opposing each other at a level lower than an upper edge 38 of the front plate 33 to provide a slight safety barricade against an involuntary slippage of the tray 22 out of the main body 20. To remove the tray, a user lifts the handle up to clear the safety barrier and pulls the tray out to empty the tray of food particles. The food particles caught by the tray are preferably between 2-5 mm in size. This would capture most rice, grains and small sized bread particles.

The food particles retained within this tray may increase in size as they absorb water.

The reservoir is formed in the bottom half of the main body 20 housing below the top half area devoted to the tray area. The guide rails 37 hold the tray within the tray area above the reservoir. The reservoir is formed between the sidewalls 32 and front wall 33 above the main body drain 24. During use, the reservoir may fill up in case of drainage block. The reservoir thus operates as a buffer against water overflowing from the front opening over the front edge 38.

Figure 3:
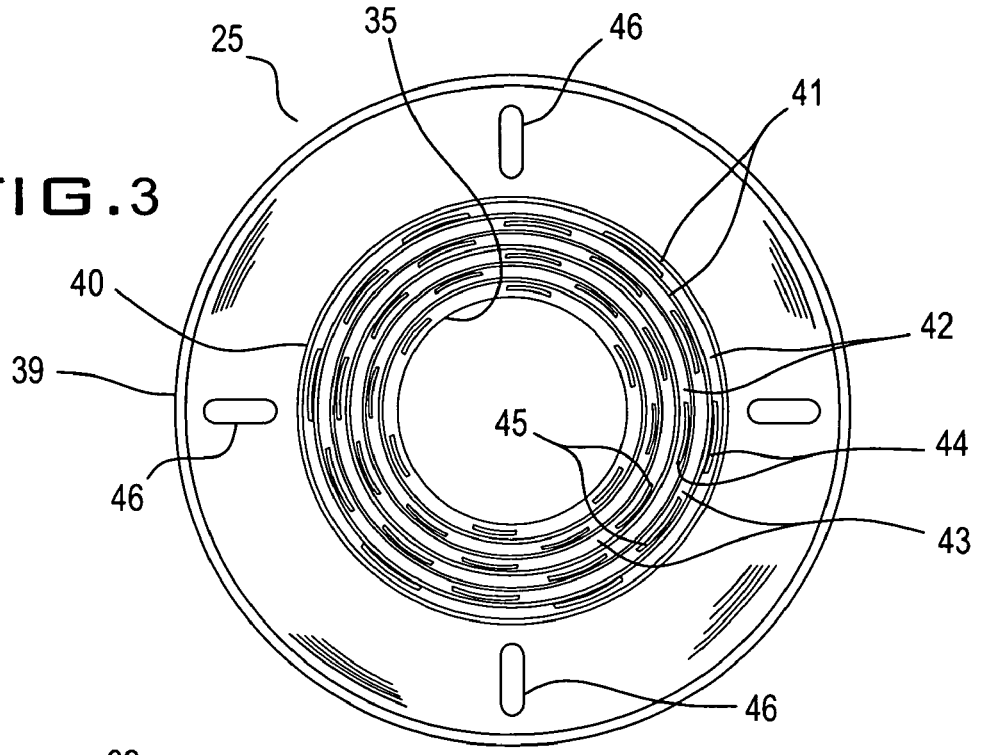
FIG. 3 is a top view of a clip disc with drain adapter constituting a base member of a clip assembly for holding the garbage unit under a bus bowl according to a first embodiment of the present invention.
Figure 4:
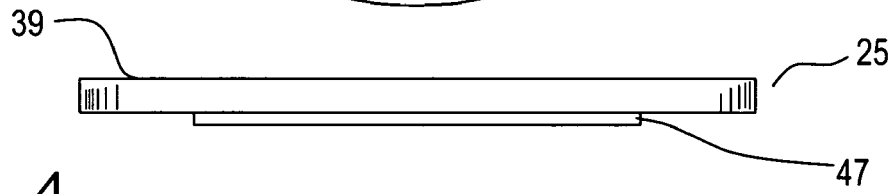
FIG. 4 is a side view of the drain adapter plate of FIG. 3.

FIGS. 3 to 4 show the clip disc 25 in closer views. The top surface of the clip disc 25 as shown in FIG. 3 is generally flat except the end walls 39 raised slightly indicating the top surface as opposed to the bottom surface of the disc 25. The disc 25 section from the annular opening 35 about a half way toward the end walls 39 is formed as a drain adapter 40 for adjusting the diameter of the annular hole 35 to adapt to a given drain diameter of an existing bus bowl. The number of optional hole diameters is defined by annular grooves 41, six of which are shown.

Two adjacent grooves 41 define an annular island 42 or 43 flush with the top surface of the disc 25. The equidistant slits 44 are for receiving a saw blade. Every other island 42 includes a number of equidistant slits 44 at a first set of the same radial positions while the intervening islands 43 include the same number of slits 45 at a second set of the same radial positions, which are set so that slits 44 and slits 45 in the adjacent islands are staggered relative to each other to maintain the rigidity of the clip disc 25. Four identical elongated openings 46 are formed in the clip disc 25 at the corresponding locations to the elongated openings 36 of the main unit body 20.

Figure 5:
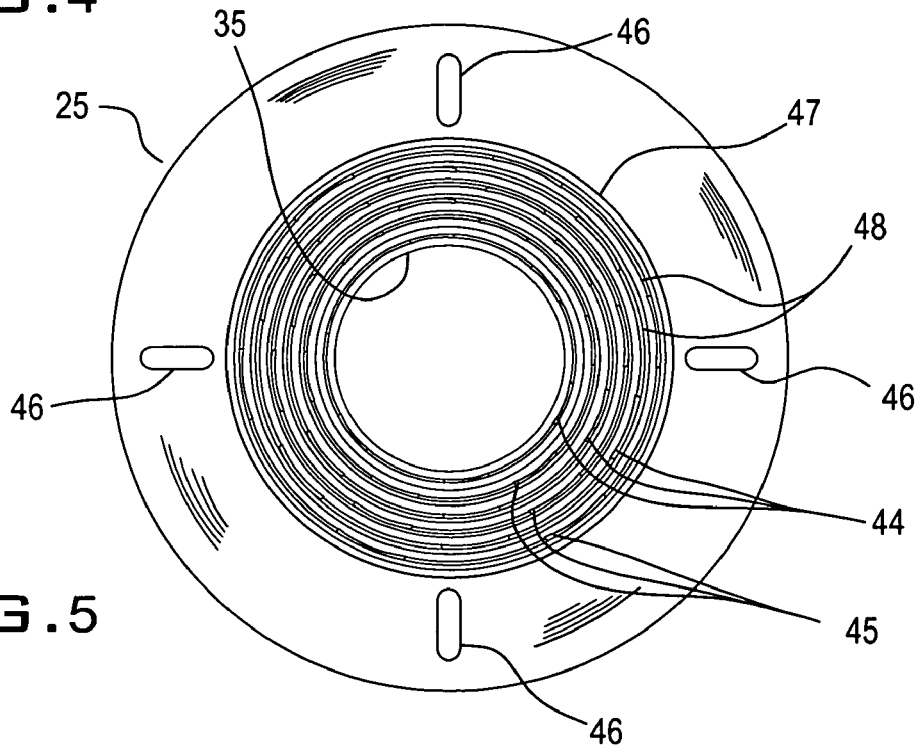
FIG. 5 is a bottom view of the drain adapter plate of FIG. 3.

FIG. 4 showing the side of clip disc 25 reveals the added thickness to the bottom of the drain adapter 40, which is bounded by an annular ridge 47 on which the annular opening 35 of the unit main body 20 engages as shown in cross section in FIGS. 6, 7, 8 and 10. The annular ridge 47 is clearly shown in FIG. 5 where the bottom side of the clip disc 25 has grooves 48 of same number as but wider than the grooves 41 on the top surface to facilitate easy access of a cutting means like a saw to the slits 44 and 45 for cutting adjustment of the size of the annular hole 35.

Figure 6:
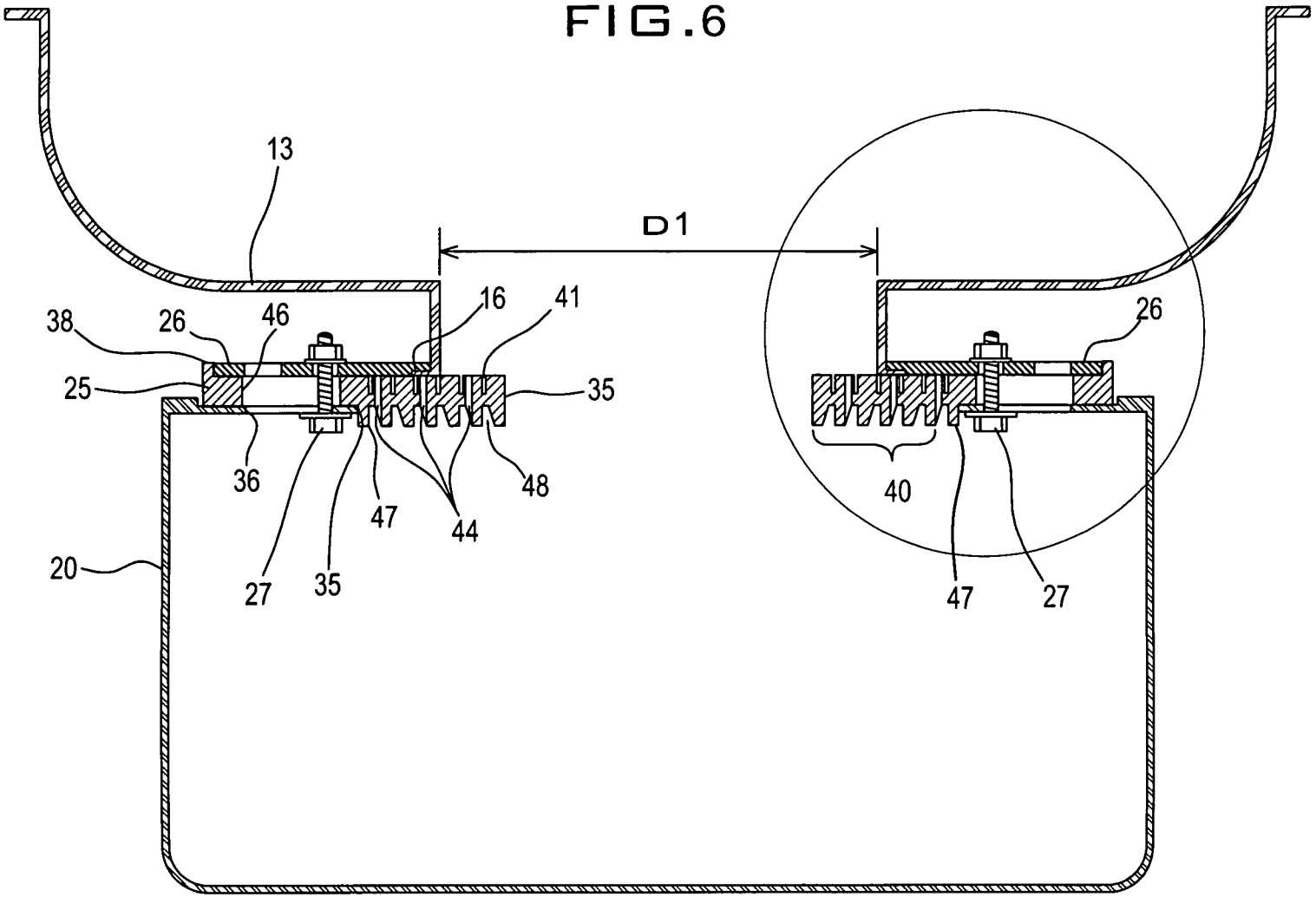
FIG. 6 is a cross sectional view of the garbage disposer replacement unit installed under a bus bowl with a smaller drain size.
Figure 8:
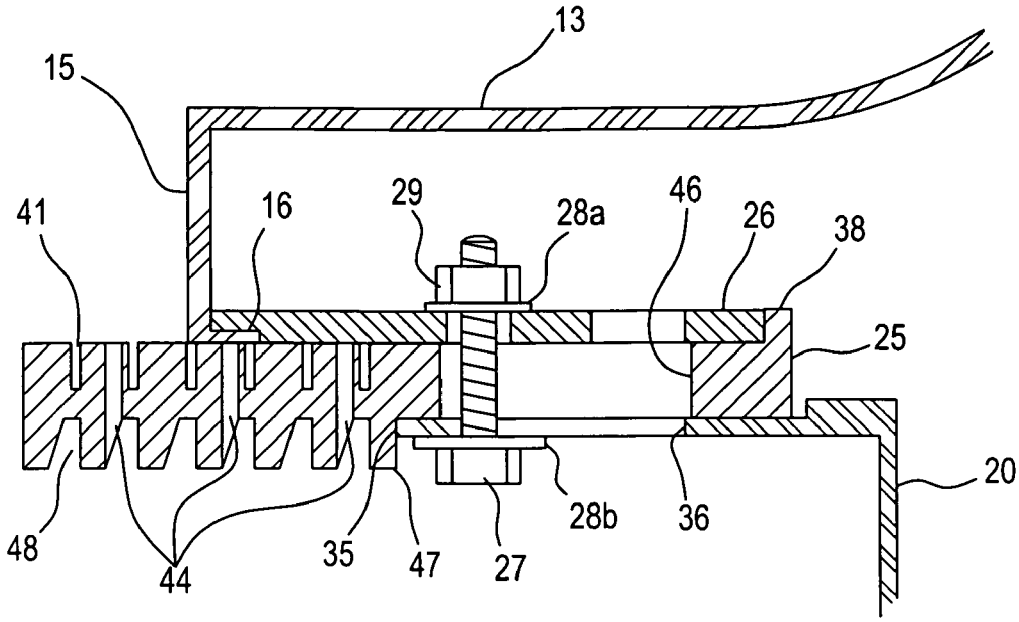
FIG. 8 is an enlarged view of the cross section of the garbage disposer replacement unit encircled in FIG. 6.

Two opposite grooves 41 and 48 can be compared in width more clearly in FIGS. 6 and 8, which detail the installation of the unit main body 20 under the bus bowl 13 with a small drain size D1 in cross section. In this case, the clip disc 25 is placed between the main body 20 and the flanges 16 of the bus bowl 13 with the annular islands 42 and 43 intact and the elongated openings 36 of the main body 20 and the openings 46 of the clip disc 25 registered.

Figure 9:
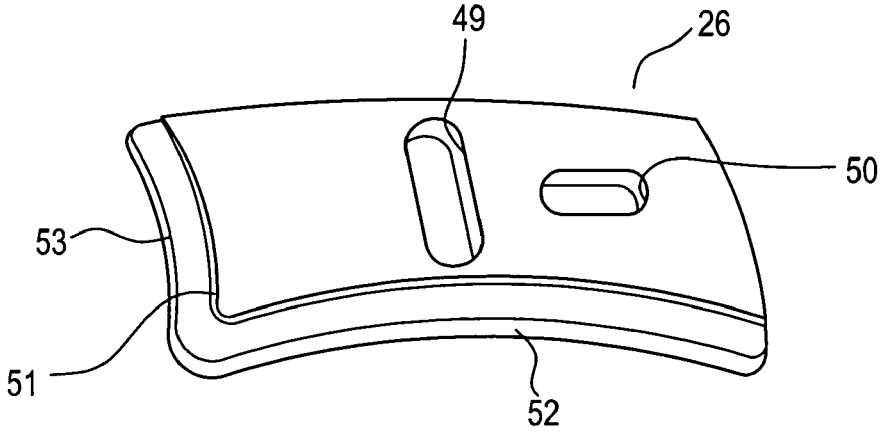
FIG. 9 is a bottom perspective view of a clip top member to clip on the flanges of the smaller drain of FIGS. 6 and 8 in cooperation with the drain adapter plate.

Then, the clip top members 26 are prepared to grip the flanges 16 against the top surface of the clip disc 25. In order to allow fastening of the clip assembly 25/26 with the main body 20, the clip top member 26 has a latitudinal slot 49 for a fastener in its center as shown in FIG. 9.

Also formed is a longitudinal slot 50, which is located off center toward a shorter side of the rectangular member 26. The clip top member 26 has a stepped bottom 51 along two adjacent sides to engage the flanges 16 of the bus bowl 13. In addition, two sets of the opposite edges of the clip member 26 are shaped to the corresponding sections of the flanges 16 and the end walls 39 of the clip disc 25 where abutments take place.

Therefore, the clip top member 26 may be selectively oriented for varying diametric distances of the flanges 16 of the bus bowl 13 relative to the end walls 38 of the clip disc 25 depending on the size of a given drain 15. I.e., the longer side 52 of the clip member 26 may abut the flanges 16 for larger drains 15 while the shorter side 53 may abut the same for smaller drains 15.

Furthermore, having two differently and perpendicularly oriented slots 49 and 50 through which a fastening is made multiplies the adaptability of the clip member 26 to a wide variety of drain sizes. As shown in FIG. 9, the bolt is put through slot 50 in smaller diameter drains to use the shorter side 53, but the bolt is put through slot 49 in larger diameter drains to use the longer side 52. Because the small diameter drain 15 is provided in FIG. 8, the clip member 26 extends longitudinally spanning the flanges 16 and the end walls 38.

Eventually, the bolts 27 are threaded from the interior of the main body 20 through metal rings 28*b* and the elongated openings 36 and through the clip assembly 25/26 to be securely fastened by the rings 28*a* and nuts 29 at its four circumferential locations around the clip disc 25.

Figure 7:
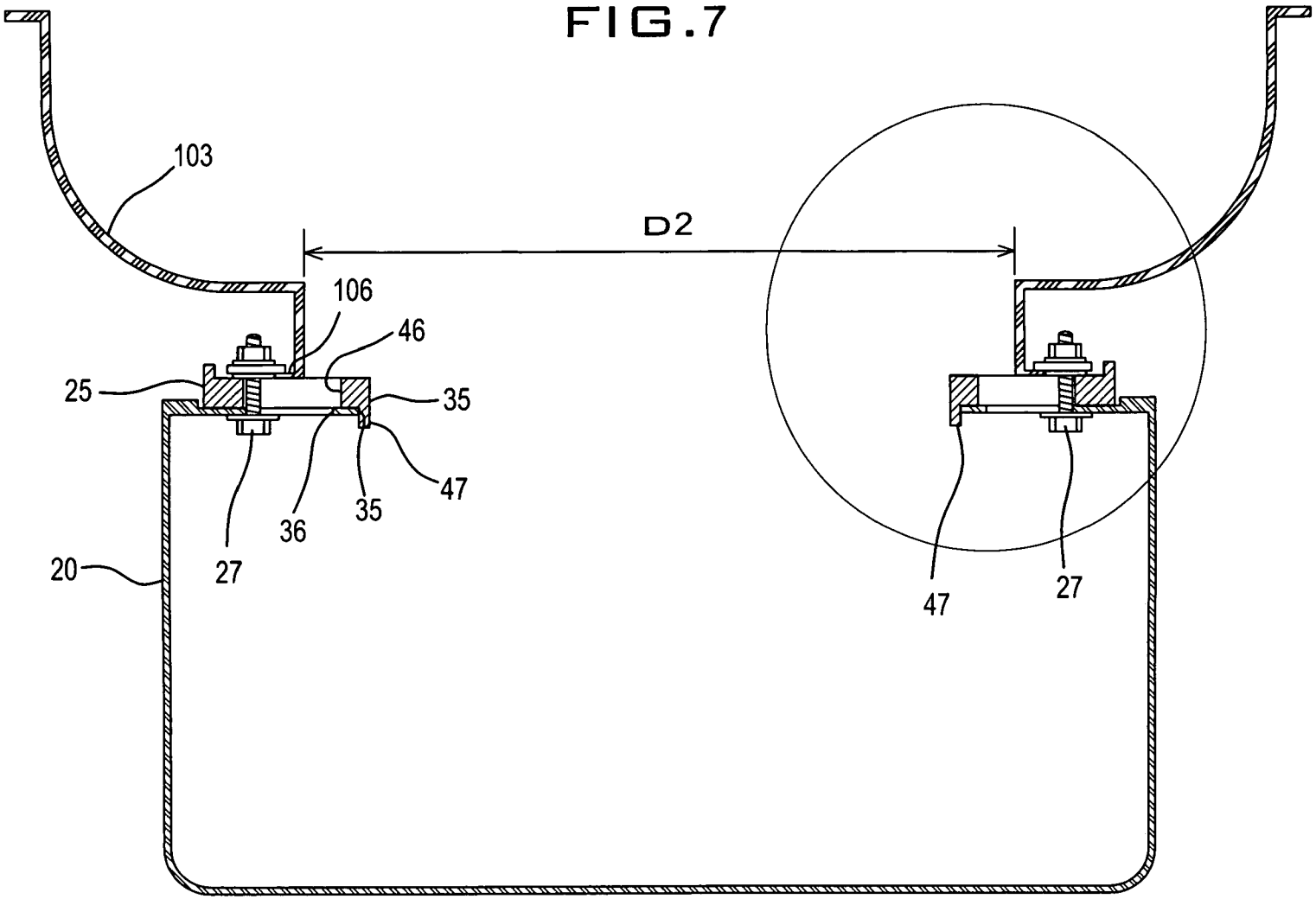
FIG. 7 is a cross sectional view of the garbage disposer replacement unit installed under a bus bowl with a bigger drain size.
Figure 10:
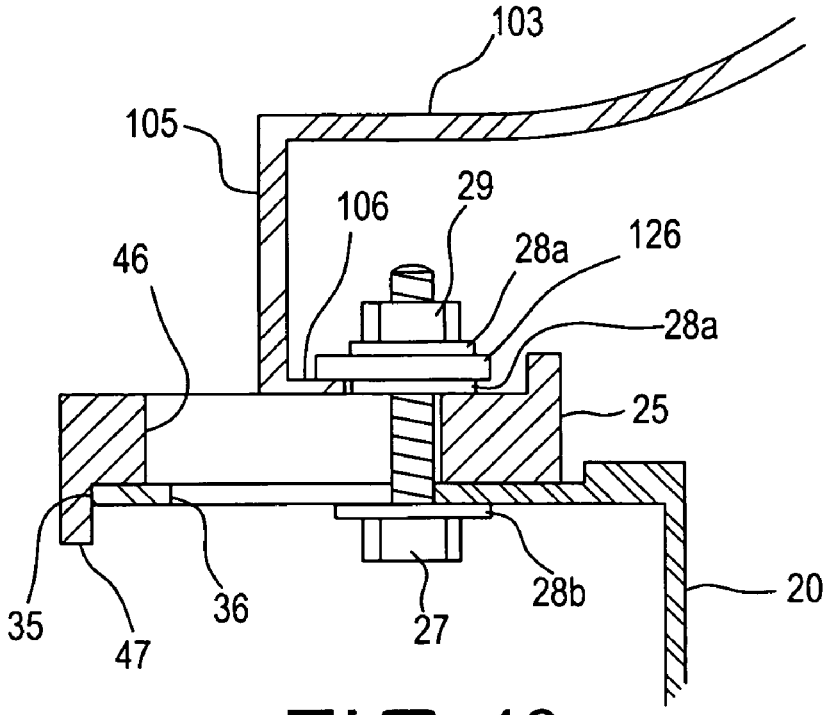
FIG. 10 is an enlarged view of the cross section of the garbage disposer replacement unit encircled in FIG. 7.

FIGS. 7 and 10 show that the same main unit body 20 is attached to a different bus bowl 103 having way larger drain size D2. In this case, the clip disc 25 has its entire drain adapter section 40 seen in FIG. 6 cut off to have the biggest adapted hole 35 and is placed between the main body 20 and the flanges 106 of the bus bowl 103 with the elongated openings 36 of the main body 20 and the openings 46 of the clip disc 25 registered.

Figure 11:
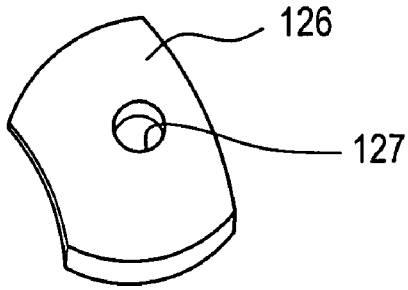
FIG. 11 is a perspective view of an alternative clip top member to clip on the flanges of the bigger drain of FIGS. 7 and 10 in cooperation with the drain adapter plate.

Here, an alternative design of clip top members 126 are prepared to grip the flanges 106 against the top surface of the clip disc 25. As shown in FIG. 11, the clip top member 126 is a smaller rectangular piece with curved edges shaped to the corresponding sections of the flanges 16 and the end walls 39 of the clip disc 25. A through hole 127 is formed in the near center of the clip member 126 for a penetration of a fastener. Clearance of the clip top member 126 above the clip disc 25 for wedging the flanges 106 is now provided by inserting an additional ring 28*a* as shown in FIG. 10.

Even with the single-hole clip member 126 there is a room for adjusting the clipping location diametrically in the clip disc 25 to adapt to a range of variation of the large diameter drain 105. A comparison of the location of the bolt 27 in the elongated openings 36 and 46 in FIG. 10 to that of FIG. 8 clearly shows the diametrical adaptability of the clipping location for the different drains 105.

Similarly, the bolts 27 are threaded from the interior of the main body 20 through metal rings 28*b* and the elongated openings 36 and through the clip assembly 25/28*a*/126 to be securely fastened by the rings 28*a* and nuts 29 at its four circumferential locations around the clip disc 25.

Figure 12:
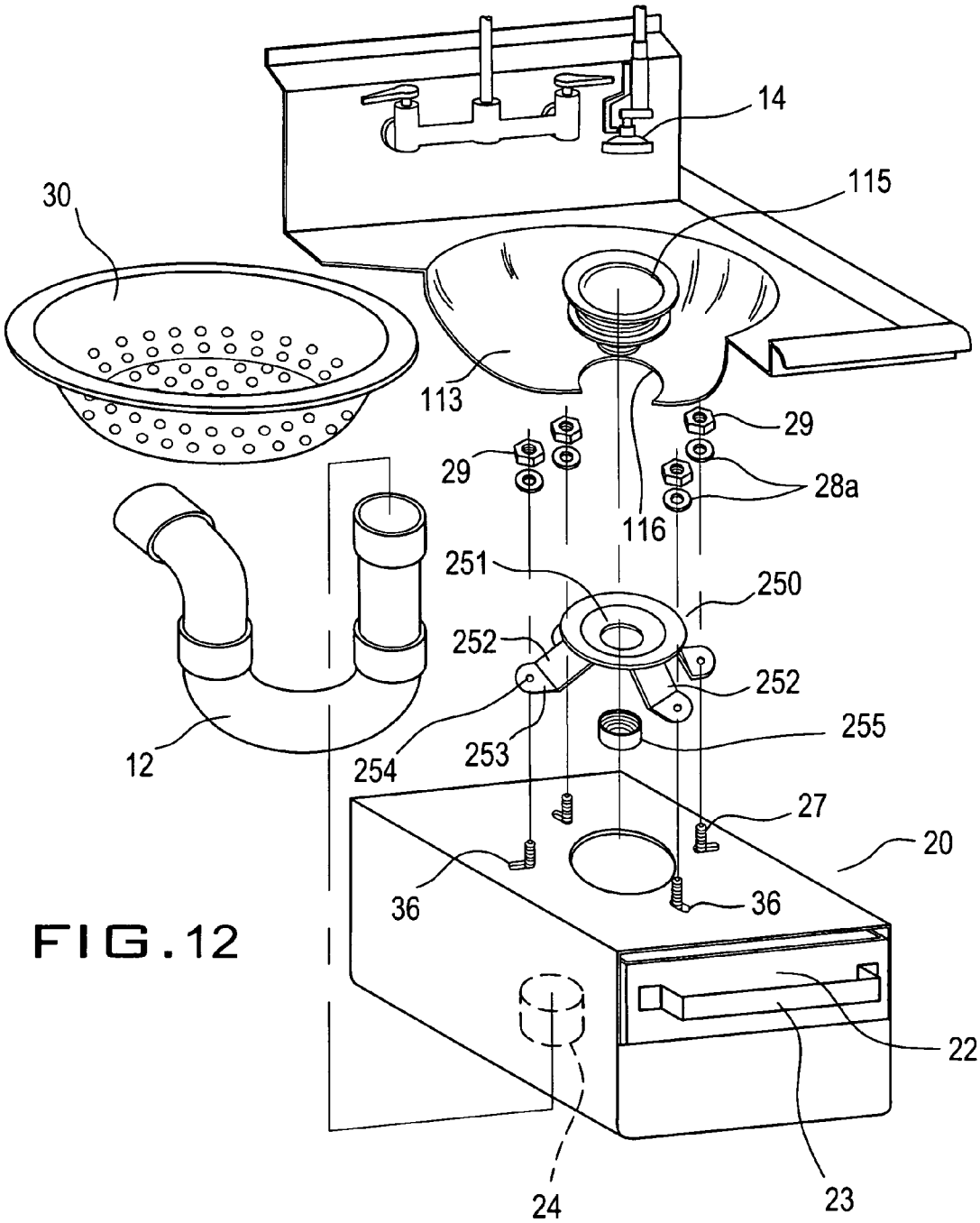
FIG. 12 is a perspective view of an alternative installation means of a riser for fastening the unit main body to a bus bowl that has a standard drain fitting according to a second embodiment of the present invention.

FIG. 12 shows an alternative to the clip assembly made by the clip disc and a top clip member in installing the unit main body 20 to a bus bowl 113, which does not have an integral drain flange but a standard drain fitting 115 screwed in an opening 116 formed in the bus bowl 113. A riser 250 is provided with an annular plate 251 to conform to the bottom of the drain fitting 115 and four legs 252 protruding diametrically outwardly and downwardly of the annular plate 251. Each of the legs 252 has a horizontal foot section 253 formed with a bolt hole 254.

The legs 252 may be integrally formed with the annular plate 251 while they may also be provided by separate members welded to the plate 251. A ring screw 255 that is already in the drain fitting 115 may be used to fasten the annular plate 251 to the drain fitting 115 leaving the four legs 252 free for attachment by the unit main body 20.

The unit main body 20 is attached by a fastening means including the bolts 27 threaded from the interior of the main body 20 through metal rings and the bolt holes 254 of the foot sections 253, which abut the top plain of the main body 20. Then, the rings 28*a* and nuts 29 at the four feet 253 around the annular plate 251 securely fasten the protruding ends of the bolts 27.

With such construction of the sink unit 10 replacing the garbage disposer the dish washing individual may first use the basket 30 in the bus bowl 13 to roughly filter out bulky wastes after a load of dish washing and before emptying the basket to an assigned container. At intervals between extended periods of washing tasks the kitchen operator may slide out the tray 22 to check for the accumulation of finer wastes in the main unit body 20 wherein a secondary filtering has been carried out by the finer perforations 31 in the tray 22 letting significantly less contaminated water pass down the secondary drain 24.

Figure 13:
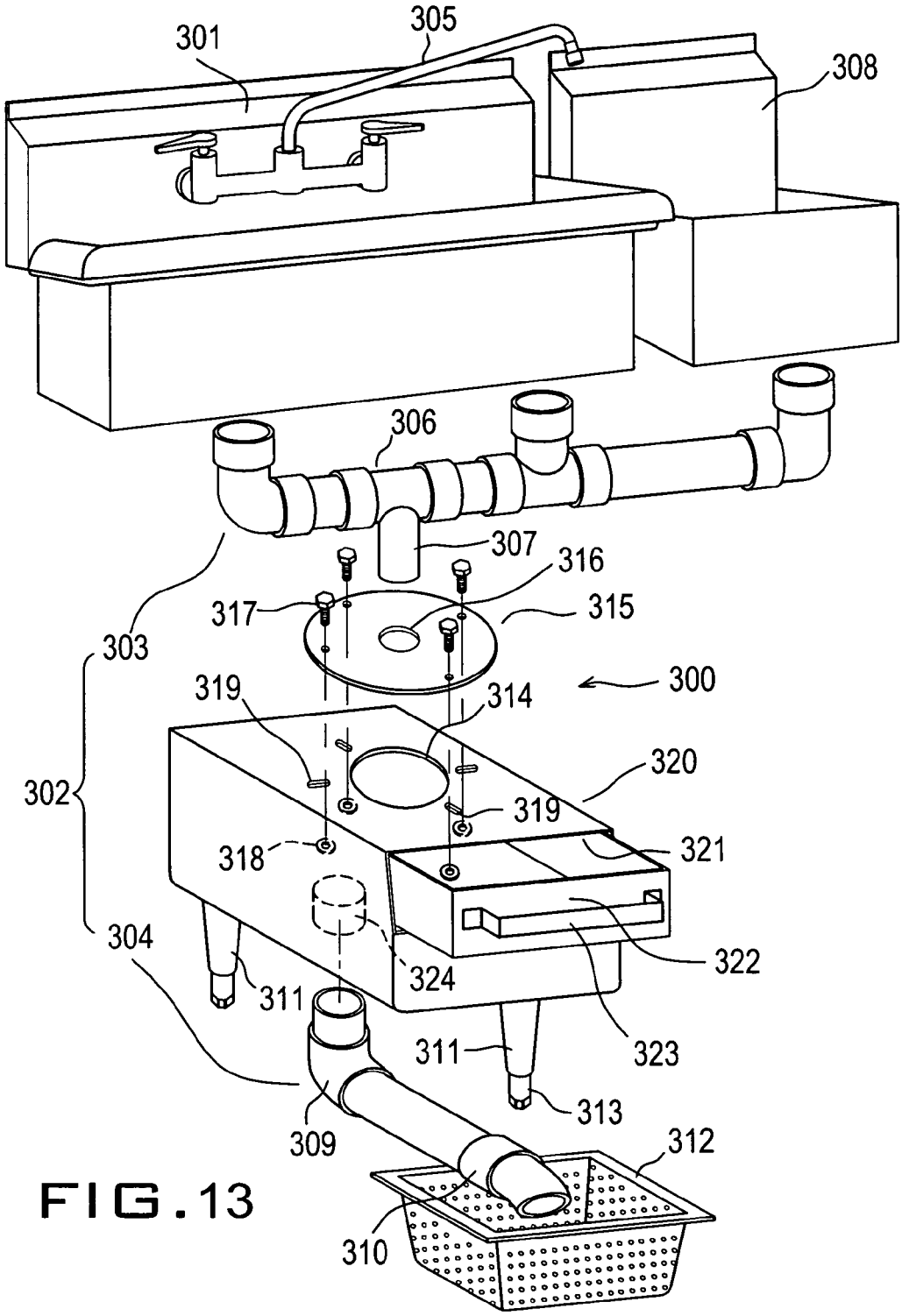
FIG. 13 is an exploded perspective view of a floor type trash interceptor according to a second embodiment of the present invention as applied to a kitchen sink.

Referring to FIG. 13, a kitchen sink trash interceptor 300 to replace a garbage disposer according to a second embodiment of the present invention is depicted in an exploded view wherein it is installed to a kitchen sink 301 at a drainage system 302 between an upper stream section 303 and a lower stream section 304 typical in a kitchen setting. The kitchen sink 301 may be a double bowl sink having a long-spout faucet 305 and is connected at its bowls to a three-bowl drain 306 with a single outlet 307 to which an extra sink 308 is connected.

The lower stream section 304 comprises a first elbow 309 facing upwardly and a second elbow 310 facing downwardly. The main garbage unit 300 stands on its own legs 311 under the sink 301 and is connected in series with the drainage system 302 between the upper and lower stream sections 303, 304. On the floor, a drain basket 312 is laid for a secondary filtering of wastewater from the garbage unit 300 at a final stage before it goes down the sewage system.

Figure 14:
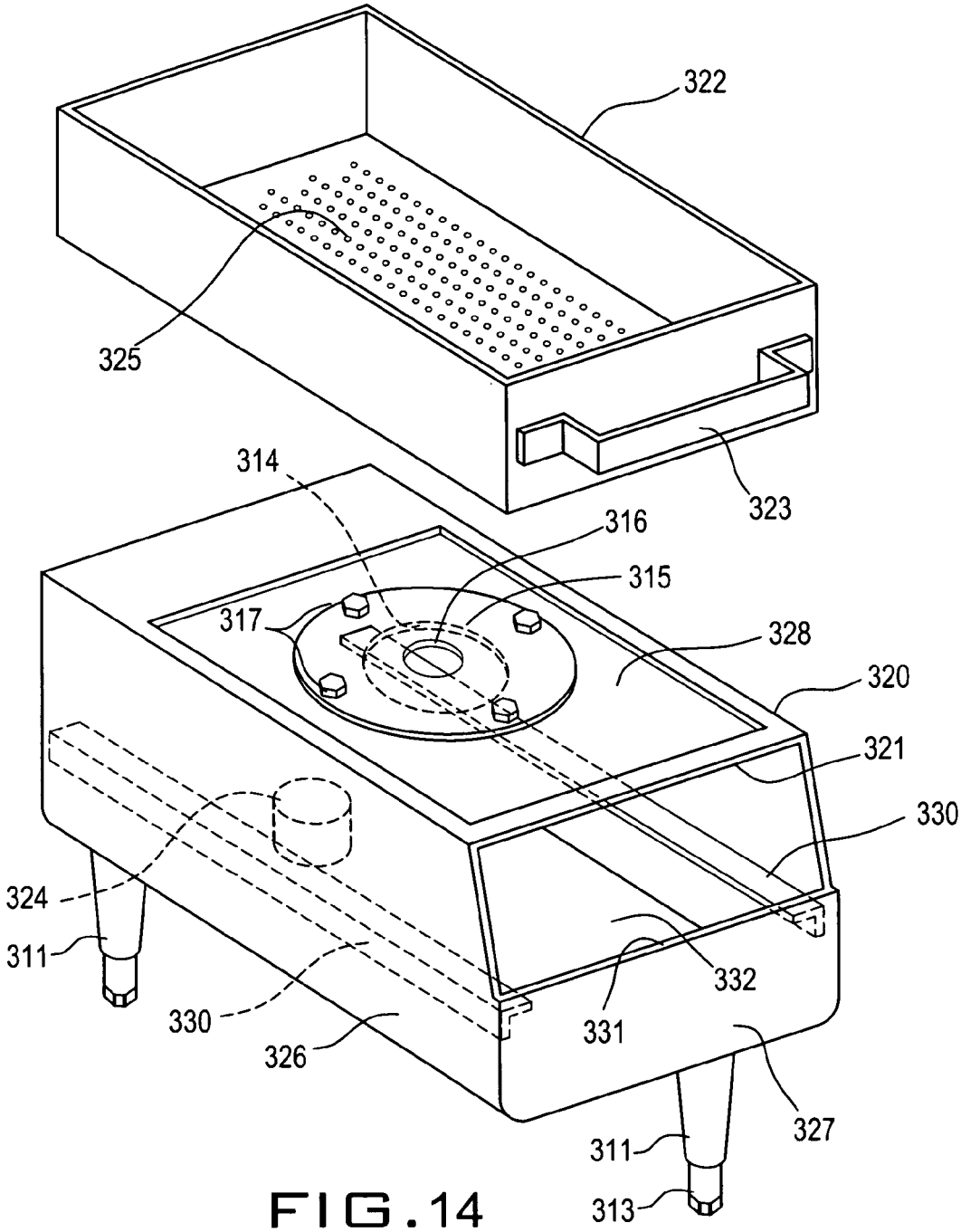
FIG. 14 is a perspective view of the main body of the trash interceptor of FIG. 13.

Referring further to FIG. 14, the garbage unit 300 comprises a main body 320 constructed by sheets of stainless steel bent and welded into a shape of a drawer box with a deep bottom floor for holding an accumulation of food wastes for controlled disposal. The main body 320 is raised from the floor by the three legs 311 having threaded feet 313, respectively. It has a large top opening 314 and an adaptor plate 315 with a selected diameter of center hole 316 to accept the drainage system 302 fitting with kitchen sink 301. The plate 315 is fastened to the top surface of the main body 320 by four sets of bolts 317 and nuts 318 at four bolt holes 319.

Also, the main body 320 has a front rectangular opening 321 though which a tray 322 enters and slidably suspended in the interior of the main body 320. An oversized handle 323 is attached to the front side of the tray 322 for handling the same in its sliding in and out as well as transporting the wastes filtered at the tray 322. The primarily filtered wastewater flows down to a drain outlet 324 formed in the bottom of the main body 30. The drain outlet 324 of the main body 320 is adapted to connect with the draining system 302.

The basket 312 has multiple straining holes for filtering food wastes off dishes by dishwashing personnel who will use the sink unit 300. The straining basket has straining holes preferably having circular 4-7 mm diameter. The basket straining holes can be adjusted by about 60% without substantial performance degradation, but the best mode is 5-6 mm of diameter.

The tray 322 is in the shape of a drawer with four sidewalls and a bottom wall formed with perforations 325 to filter out wastes primarily. Each tray perforation is preferably 1-3 mm diameter circular aperture. The diameter can be adjusted by about up to 40% without substantial performance degradation, but the best mode is 2 mm.

The main body 320 is provided by a number of sheet members which may comprise a side plate 326 bent generally in U-shape, a front plate 327 for closing substantially the bottom half of an end opening of the side plate 326, a rear plate for closing the entire opposite end opening of the side plate 326 and a top plate 328 to cover the top opening of the side plate 326.

Stainless steel may be used for making the main body 320. It may be fabricated by known methods of fastening metal such as stamping, spot welding, laser welding to name a few.

The rectangular opening 321 is slanted backwardly relative to the face of the adjacent front plate 327 extending its latitudinal dimension so that the tray 322 may enter and exit the main body 320 rapidly and repeatedly with ease even during busy kitchen hours.

The opening 314 formed in the top plate 328 occupies the substantial area thereof and is redefined by the center hole 316 of the adaptor plate 315. The adaptor plate 315 is also a flat disc with a plurality of peripheral holes where the bolts 317 are threaded through the top plate 328. In the present embodiment, four bolt holes are formed. A set of adaptor plates 315 may be provided with different diameters of the center hole 316 from which an installer of the garbage unit 300 selects the best fit with the particular drainage system 302.

A pair of horizontal guide rails 330 having an L-shaped cross section are welded inside of the side plate 326 opposing each other at a level slightly lower than an upper edge 331 of the front plate 327 to provide a safety stop against an involuntary slippage of the tray 322 out of the main body 320. To remove the tray 322, a user starts by pulling the handle 323 slightly upward to clear the safety stop and draw the tray 322 out to empty the tray of food particles. The minimum food particles caught by the tray are preferably between 2-5 mm in size. This would capture most rice, grains and small sized bread particles. The food particles retained within this tray may increase in size as they absorb water.

A reservoir 332 is formed in the bottom half of the main body 320 below the top half area devoted to the tray area. The guide rails 330 hold the tray 322 within the tray area above the reservoir 332. The reservoir 332 is formed between the sidewalls 326 and front wall 327 above the main body drain 324. During normal use, when the tray 322 is pulled out to remove wastes the reservoir 332 initially receives newly introduced debris through the upper tray area and passes it down to the lower drainage section 304 for the subsequent collection at the drain basket 312 as described above with reference to FIG. 13.

Then, the reservoir 322 may fill up in case of drainage block. The reservoir thus operates as a buffer against water overflowing from the front opening 321 over the front edge 331.

Figure 15:
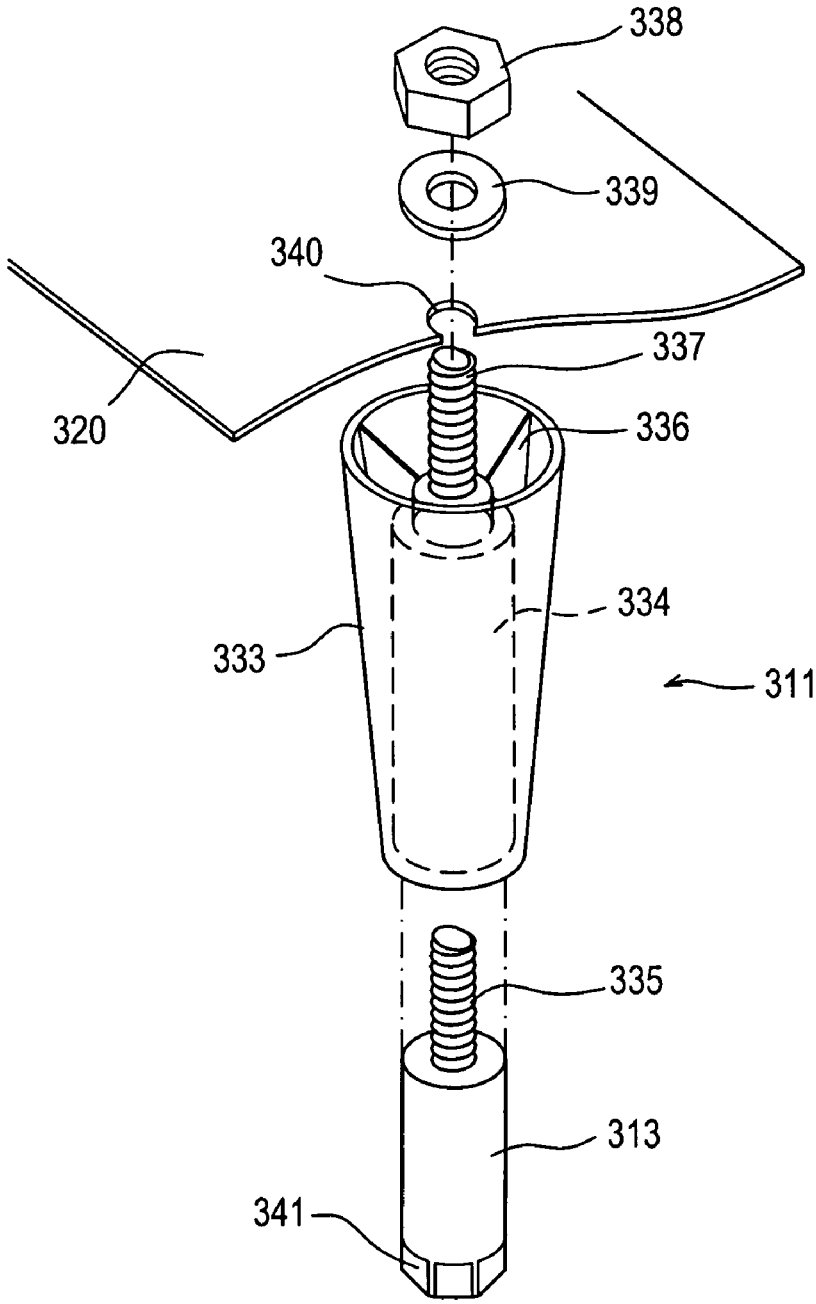
FIG. 15 is an exploded view of an adjustable leg supporting the trash interceptor of FIG. 13.

FIG. 15 shows one of the legs 311 supporting the garbage unit main body 320 in greater detail. The leg 311 comprises an inverted frusto-conical pillar 333, a cylindrical core 334 bored centrally with female threads and the foot 313 having its top extension 335 threaded into the cylindrical core 334.

The cylindrical core 334 is fixed concentrically to the interior of the pillar 333 through a plurality of vertical vanes 336 and has a top shaft 337 threaded externally to allow fastening the leg 311 to the body 320. Nut 338 and washer 339 may be used to secure the top shaft 337 of the leg 311 penetrating a bolt hole 340 through the bottom wall of the main body 320. In addition, the foot 313 is provided with engagement faces 341 at its bottom end to facilitate turning the foot 313 about the pillar 333.

The garbage disposer replacement unit 300 of the present invention is not limited in installation to replace single existing garbage disposer but multiple compartments of more than one sink may be connected to the single disposer unit 300 in order to achieve a concentrated and thus quick sanitary disposal of food wastes even from heavy-duty kitchen sinks.

Figure 16:
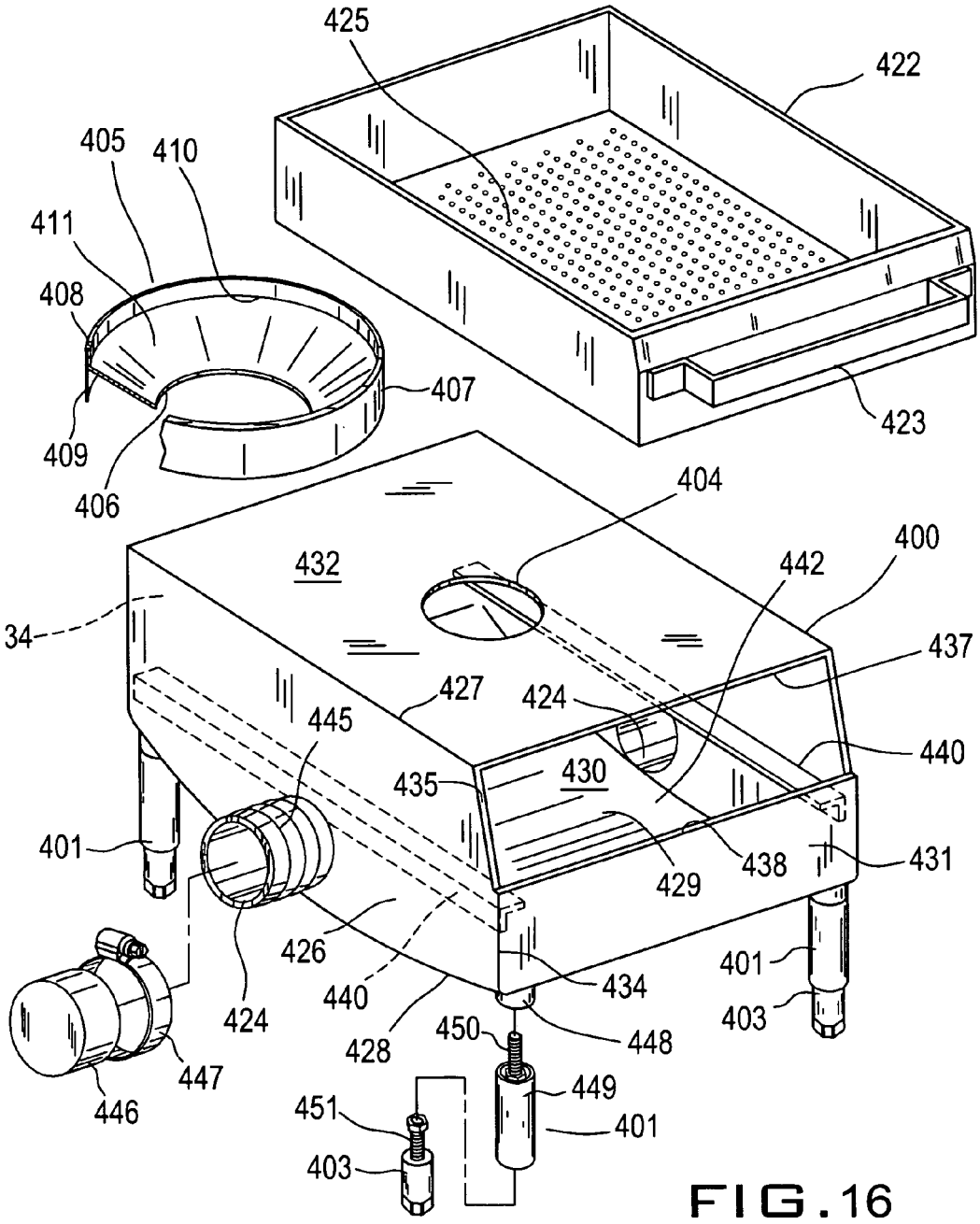
FIG. 16 is an exploded perspective view of a trash interceptor according to a third embodiment of the present invention.

FIG. 16 shows an alternative floor type trash interceptor according to a third embodiment of the present invention wherein a main body 400 constructed by sheets of stainless steel bent and welded into a shape of a drawer box with a deep bottom floor for holding an accumulation of food wastes for controlled disposal. The main body 400 is supported by four removable legs 401 each having a threaded foot 403, which may be rotated to adjust the elevation of each corner of the interceptor body 400. The leg 401 may be replaced by a longer one as needed by the particular kitchen design. The interceptor 400 has a large top opening 404 and an adaptor funnel 405 with a center hole 406 positioned concentrically over the top opening 404 of the interceptor body 400. The funnel 405 accepts the drainage system 302 fitting with kitchen sink 301 as shown in FIG. 13. The funnel 405 may be made of a stainless steel and consisted of an annular peripheral wall 407 having a thicker upper section 408 near the top edge of the funnel 405 and a thinner lower section 409 forming an annular step 410, and an inverted frusto-conical plate 411 having an outer peripheral that fits within the inner diameter of the annular wall 407 to be welded thereto at the annular step 410. The free end of the conical plate 411 converges to the center hole 406 positioned below the level of lower section 409. A short ring member may be provided so that it is welded to the inner top area of the annular wall 407 to achieve the thickness of the upper wall section 408 for securing the conical plate 411 in the annular wall 407 at the predetermined level.

Such funnel 405 is placed on the top surface of the interceptor body 400 concentrically to the top opening 404 with the protruding circular edge of the center hole 406 pressing on the top surface of the interceptor body 400. Applying silicone sealant at the contact area of the center hole 406 with the interceptor body 400 may conveniently form a secure watertight junction between the two components. Due to the conical contact surfaces with a drain outlet such as the outlet 307 of FIG. 13, the funnel 405 becomes a universal drainage adapter for connecting virtually infinite varieties of outlet diameters between sizes 3½"-9" and more to the interceptor 400.

Also, the interceptor body 400 has a front rectangular opening 421 though which a tray 422 enters and slidably suspended in the interior of the interceptor body 400. An oversized handle 423 is attached to the front side of the tray 422 for handling the same in its sliding in and out as well as transporting the wastes filtered at the tray 422. The primarily filtered wastewater flows down to opposite side outlets 424 formed in the bottom of the main body 400.

The side outlet 424 of the main body 400 is positioned at a lowermost level of the interior of the interceptor body 400 and is adapted to connect with output side of the draining system 302.

The tray 422 is in the shape of a drawer with four sidewalls and a bottom wall formed with perforations 425 to filter out wastes primarily. The tray perforations are preferably 1-3 mm diameter of circular apertures. The diameter can be adjusted by about up to 40% without substantial performance degradation, but the best mode is 2 mm.

The interceptor body 400 is provided by a number of sheet metal members which are welded together and may comprise two symmetrically shaped side plates 426 each having a straight top side edge 427 and a convex bottom edge 428, a bottom plate 429 for closing a rear wall (not shown), bottom wall 430 and lower front wall 431 sections of the interceptor body 400 and a horizontal and rectangular top plate 432 with the opening 404 formed in the middle. The side plate 426 also has an upright rear end 433 and an upright front end 434 deflected rearward near the midpoint of its length to form a slanted upper front end 435 increasing its distance to merge the top plate 432 at a top front edge 436 thereof. Thus, there is formed a wide rectangular opening 437 defined by an upper edge 438 of the front wall 431, two parallel front ends 435 and the top front edge 436 so that the tray 422 may enter and exit the main body 400 rapidly and repeatedly with ease even during busy kitchen hours.

Two horizontal guide rails 440 having an L-shaped cross section are welded inside of the side plate 426 opposing each other at a level slightly lower than the upper edge 438 of the front wall 431 to provide a safety stop against an involuntary slippage of the tray 422 out of the main body 400. To remove the tray 422, a user starts by pulling the handle 423 slightly upward to clear the safety stop and draw the tray 422 out to empty the accumulation of food particles.

The minimum food particles caught by the tray 422 are preferably between 2-5 mm in size. This would capture most rice, grains and small sized bread particles. The food particles retained within this tray may increase in size as they absorb water.

A convex reservoir 442 is formed in the bottom half of the main body 400 below the top half area devoted to the tray area. The guide rails 440 hold the tray 422 within the tray area above the reservoir 442. The bottom wall 430 is contoured so that it lies highest in the reservoir 442 and gradually descends toward the side outlets 424 and slightly ascends toward the front wall 431. For example, the rear end 433 of the side plate 426 may be 5 inches to the top plate 432 while the lowermost point in the convex edge 428 may extend 6 inches to the top plate 432.

Therefore, any liquid slurries of food trash will move to the side outlets 424 positioned at the lowermost points of the reservoir 442. The side outlet 424 is also provided with several protruded edges 445 to form a grip surface on which an optional soft cap 446 may be tightened to close the distal end opening of an inactive pair of the outlets 424. A worm-gear clamp 447 may be used to hold the cap 446 on watertight. Although not shown, a simple round plug may block the other proximal end opening of the same outlet 424 to prevent stuff to be lodged inside the outlet 424.

A draining basket such as depicted at 312 in FIG. 13, can be removably positioned under at least one of the reservoir outlets for Catching escaped waste bypassing the main body.

FIG. 16 is thus an alternate embodiment that also shows one of the four legs 401 supporting the interceptor body 400 in an exploded view. The leg 401 comprises a permanent base 448 welded to a corner of the bottom wall 430 and threaded inwardly, a removable cylindrical rod 449 with a top threaded connector 450 and the foot 403 having a top extension 451 adjustably threaded into the rod 449.

A lower portion of the convex bottom extends from the left to the right side of the main body. The bottom of the unit is preferably made by bending a sheet of stainless steel to have a higher level at a front and rear portion while dipping into a lower part in the middle of the main body. The connection between the side outlet and the convex reservoir 442 preferably has a smooth interface so that the lower portion extends laterally from the left side outlet 424 to the right side outlet.

A variety of obvious modifications can be made to this trash interceptor. Therefore, while the presently preferred form of the trash interceptor has been shown and described, and several modifications thereof discussed, persons skilled in this art will readily appreciate that various additional changes and modifications may be made without departing from the spirit of the invention, as defined and differentiated by the following claims.

CALL OUT LIST OF ELEMENTS

| | |
|---|---|
| 10: | Garbage Disposer Replacement Unit |
| 11: | Kitchen Sink |
| 12: | Wall Plumbing |
| 13: | Bus Bowl |
| 14: | Faucet |
| 15: | Drain |
| 16: | Flanges |
| 20: | Unit Main Body |
| 21: | Rectangular Opening |
| 22: | Tray |
| 23: | Handle |
| 24: | Secondary Drain |
| 25: | Clip Disc |
| 26: | Clip Top Member |
| 27: | Bolt |
| 28a, 28b: | Rings |
| 29: | Nut |
| 30: | Basket |
| 31: | Perforations |
| 32: | Side Plate |
| 33: | Front Plate |
| 34: | Top Plate |
| 35: | Annular Opening |
| 36: | Elongated Opening |
| 37: | Guide Rail |
| 38: | Upper Edge |
| 39: | Raised End Walls |
| 40: | Drain Adapter |
| 41: | Grooves |
| 42, 43: | Annular Islands |
| 44, 45: | Slits |
| 46: | Elongated Opening |
| 47: | Annular Ridge |
| 48: | Wide Grooves |
| 49: | Latitudinal Slot |
| 50: | Longitudinal Slot |
| 51: | Stepped Bottom |
| 52: | Longer Side |
| 53: | Shorter Side |
| 103: | Bus Bowl |
| 105: | Drain |
| 106: | Flanges |
| 113: | Bus Bowl |
| 115: | Standard Drain Fitting |
| 116: | Opening |
| 126: | Clip Top Member |
| 127: | Through Hole |
| 250: | Riser |
| 251: | Annular Plate |
| 252: | Leg |
| 253: | Foot Section |
| 254: | Bolt Hole |
| 255: | Ring Screw |
| D1: | Small Drain Size |
| D2: | Larger Drain Size |
| 300: | Garbage Disposer Replacement Unit |
| 301: | Kitchen Sink |
| 302: | Drainage System |
| 303: | Upper Stream Section |
| 304: | Lower Stream Section |
| 305: | Faucet |
| 306: | Drain |
| 307: | Outlet |
| 308: | Extra Sink |
| 309: | First Elbow |
| 310: | Second Elbow |
| 311: | Leg |
| 312: | Drain Basket |
| 313: | Threaded Foot |
| 314: | Top Opening |
| 315: | Adaptor Plate |

-continued

| | |
|---|---|
| 316: | Center Hole |
| 317: | Bolt |
| 318: | Nut |
| 319: | Bolt Hole |
| 320: | Main Body |
| 321: | Front Opening |
| 322: | Tray |
| 323: | Handle |
| 324: | Drain Outlet |
| 325: | Perforations |
| 326: | Side Plate |
| 327: | Front Plate |
| 328: | Top Plate |
| 330: | Guide Rail |
| 331: | Upper Edge |
| 332: | Reservoir |
| 333: | Pillar |
| 334: | Cylindrical Core |
| 335: | Top Extension |
| 336: | Vertical Vane |
| 337: | Top Shaft |
| 338: | Nut |
| 339: | Washer |
| 340: | Bolt Hole |
| 341: | Engagement Face |

The invention claimed is:

1. A garbage disposer replacement unit for straining food waste from a drain outlet of a food preparation sink comprising:

a. an adapter funnel having an inverted frusto-conical top surface for fitting with various diameters of the drain outlet of the sink;

b. a main body fluidly connected in series with the sink drain outlet through the adapter funnel, the main body including a convex reservoir, wherein the convex reservoir has a lowermost level extending between a left and a right side of the main body;

c. two opposite side outlets positioned at the lowermost level of the convex reservoir, a tray slidingly suspended within the main body above the convex reservoir and having fine bottom perforations and a number of legs for supporting the main body above a floor; and d. a draining basket removably positioned under at least one of the reservoir outlets for catching escaped waste bypassing the main body.

2. The garbage disposer replacement unit of claim 1, wherein the fine bottom perforations are about 2 mm diameter circular apertures.

3. The garbage disposer replacement unit of claim 1, further comprising:

a. an opening on the top surface of the main body;

b. a larger opening at the center of the adaptor funnel positioned concentrically over the top opening of the main body for redefining the opening of the main body to fit with the sink drain outlet.

4. The garbage disposer replacement unit of claim 1, wherein the supporting legs of the main body each has threaded sections movable relative to each other along a common longitudinal axis to adjust the length of the leg, whereby the main body stands at level.

5. A garbage disposer replacement unit for straining food waste comprising:

a. an adapter funnel having an inverted frusto-conical top surface for fitting with various diameters of the drain outlet of the sink;

b. one or more sinks; the sinks receiving restaurant wastewater;

c. a drain receiving restaurant wastewater from the one or more sinks;

d. a main body fluidly connected in series with the sink drain outlet through said adapter funnel, the main body including a convex reservoir, wherein the convex reservoir has a lowermost level extending between a left and a right side of the main body;

e. two opposite side outlets positioned at the lowermost level of the convex reservoir, a tray slidingly suspended within the main body above the reservoir for catching particles in restaurant wastewater and having fine bottom perforations and a number of legs for supporting the main body above a floor, the main body having a top opening; and f. a draining basket removably positioned under at least one of said outlets.

6. The garbage disposer replacement unit of claim 5, wherein the fine bottom perforations are about 2 mm diameter circular apertures.

7. The garbage disposer replacement unit of claim 5, further comprising:

a. a circular opening on the top surface of the main body;

b. a larger opening at the center of the adaptor funnel positioned concentrically over the top opening of the main body for redefining the opening of the main body to fit with the sink drain outlet.

8. The garbage disposer replacement unit of claim 5, wherein the supporting legs of the main body each has threaded sections movable relative to each other along a common longitudinal axis to adjust the length of the leg, whereby the main body stands at level.

9. The garbage disposer replacement unit of claim 8, further comprising:

a. a circular opening on the top surface of the main body;

b. a larger opening at the center of the adaptor funnel positioned concentrically over the top opening of the main body for redefining the opening of the main body to fit with the sink drain outlet.

* * * * *